United States Patent [19]

Rohner

[11] 4,321,736

[45] Mar. 30, 1982

[54] APPARATUS FOR EXTENDING A WARP FED TO A TUFTING MACHINE

[75] Inventor: Joachim Rohner, Monchen-Gladbach, Fed. Rep. of Germany

[73] Assignee: W. Schlafhorst & Co., Monchen-Bladbach, Fed. Rep. of Germany

[21] Appl. No.: 113,024

[22] Filed: Jan. 17, 1980

[30] Foreign Application Priority Data

Jan. 19, 1979 [DE] Fed. Rep. of Germany ..... 2902003

[51] Int. Cl.[3] ..... B65H 69/00; D03J 1/18

[52] U.S. Cl. ..... 28/210; 112/79 R

[58] Field of Search ..... 28/209, 210, 211; 112/79 R; 57/261, 22, 350

[56] References Cited

U.S. PATENT DOCUMENTS

| | | | |
|---|---|---|---|
| 2,717,117 | 9/1955 | Felton | 28/211 |
| 2,845,686 | 8/1958 | Mason | 28/209 |
| 2,863,492 | 12/1958 | Chang et al. | 28/209 |
| 3,407,583 | 10/1968 | Irwin et al. | 28/271 X |
| 3,461,661 | 8/1969 | Irwin et al. | 57/22 |
| 3,813,742 | 6/1974 | Bar | 28/211 |
| 3,879,824 | 4/1975 | Mizuno | 28/211 X |
| 4,232,509 | 11/1980 | Rohner et al. | 242/35.6 X |

*Primary Examiner*—Ronald Feldbaum

*Attorney, Agent, or Firm*—Herbert L. Lerner

[57] ABSTRACT

Method for extending a warp fed to a tufting machine, which includes securing trailing thread ends of the warp to be extended with a holding device, pulling the leading thread ends of a new warp from a thread accumulator, securing the leading thread ends of the new warp with a further holding device, subsequently joining each individual thread of the warp to be extended to a thread of the new warp with a spliced joint, and cutting off and sucking away the two overhanging thread ends of the spliced joint, and an apparatus for carrying out the method.

6 Claims, 4 Drawing Figures

APPARATUS FOR EXTENDING A WARP FED TO A TUFTING MACHINE

The invention relates to a method and apparatus for extending a warp fed to a tufting machine.

In known tufting machines, 500 to 3000 individual threads are combined to form a group of threads or a warp. The threads are pulled off from individual coils combined in a creel. A problem experienced therewith is that the length of the warp is limited by the maximally possible size of the individual coils.

Since tufting machines process relatively thick threads, it is unfavorable to extend the warp by tying-on new threads, since the knots have a highly disturbing effect. Therefore, threads have also been joined together by cementing. Cementing the ends of the threads, however, requires a minimum amount of time which depends not in the least on the type of adhesive, and in the case of 3000 individual threads, amounts to about 18 to 24 hours. Of course, the shut-down time of the tufting machine caused thereby, reduces the efficiency of the machine. In addition, a cemented thread joint is also disturbing in the tufting operation as well as in the finished product.

It is accordingly an object of the invention to provide a method and apparatus for extending a warp fed to a tufting machine which overcomes the hereinaforementioned disadvantages of the heretofore known devices of this general type, and to reduce the time required for the extending operation as well as to provide thread joints which no longer noticeably interfere with respect to processability within the tufting machine as well as later in the finished product.

With the foregoing and other objects in view, there is provided, in accordance with the invention, a method for extending a warp fed to a tufting machine, which comprises securing trailing thread ends of the warp to be extended with a holding device, pulling the leading thread ends of a new warp from a thread accumulator, securing the leading thread end of the new warp with a further holding device, subsequently joining each individual thread of the warp to be extended to a thread of the new warp with a spliced joint, and cutting off and sucking away the two overhanging thread ends of the spliced joint.

In accordance with another mode of the invention, there is provided a method which comprises pulling the thread ends of the new warp from at least one beam of the thread accumulator. This spliced joint can be made by hand as well as automatically or semiautomatically. In any event, a spliced joint, according to experience, is the best way of joining threads for a tufting machine.

In accordance with a first feature of the invention, there is provided an apparatus for carrying out a method for extending a warp fed to a tufting machine comprising at least one thread accumulator having at least part of a new warp wound thereon, a first holding device for holding trailing thread ends of the warp to be extended, the first holding device being disposed between the tufting machine and the at least one thread accumulator, a second holding device for holding leading thread ends of the new warp, and a pneumatic splicing device for joining the leading and trailing threads.

In accordance with another feature of the invention, the at least one thread accumulator includes at least one beam.

In accordance with a further feature of the invention, the pneumatic splicing device includes a splicing head, a first suction nozzle disposed on a side of the splicing head facing the tufting machine for sucking in the leading thread ends of the new warp, and a second suction nozzle disposed on another side of the splicing head facing the at least one thread accumulator for sucking in the trailing ends of the warp to be extended.

In accordance with an added feature of the invention, the pneumatic splicing device is disposed between the tufting machine and the first holding device.

In accordance with an additional feature of the invention, the splicing head is disposed below the warp to be extended and has a thread receiving slot formed therein facing toward the warp to be extended.

In accordance with an additional feature of the invention, there is provided an operating walkway having lateral boundaries formed by the first and second holding device, the operating walkway being open before the warps are joined together.

In accordance with yet another feature of the invention, the warp to be extended is at least partially vertically disposed, and the splicing head is disposed alongside the vertical part of the warp to be extended and has a thread receiving slot formed therein facing toward the vertical part of the warp to be extended.

In accordance with yet a further feature of the invention, there is provided a track disposed transversely to the warp to be extended, the pneumatic splicing device being movably disposed on the track.

In accordance with a concomitant feature of the invention, there is provided means for cutting off the thread ends after joining.

Other features which are considered as characteristic for the invention are set forth in the appended claims.

Although the invention is illustrated and described herein as embodied in method and apparatus for extending a warp fed to a tufting machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing, in which.

Figure 1:
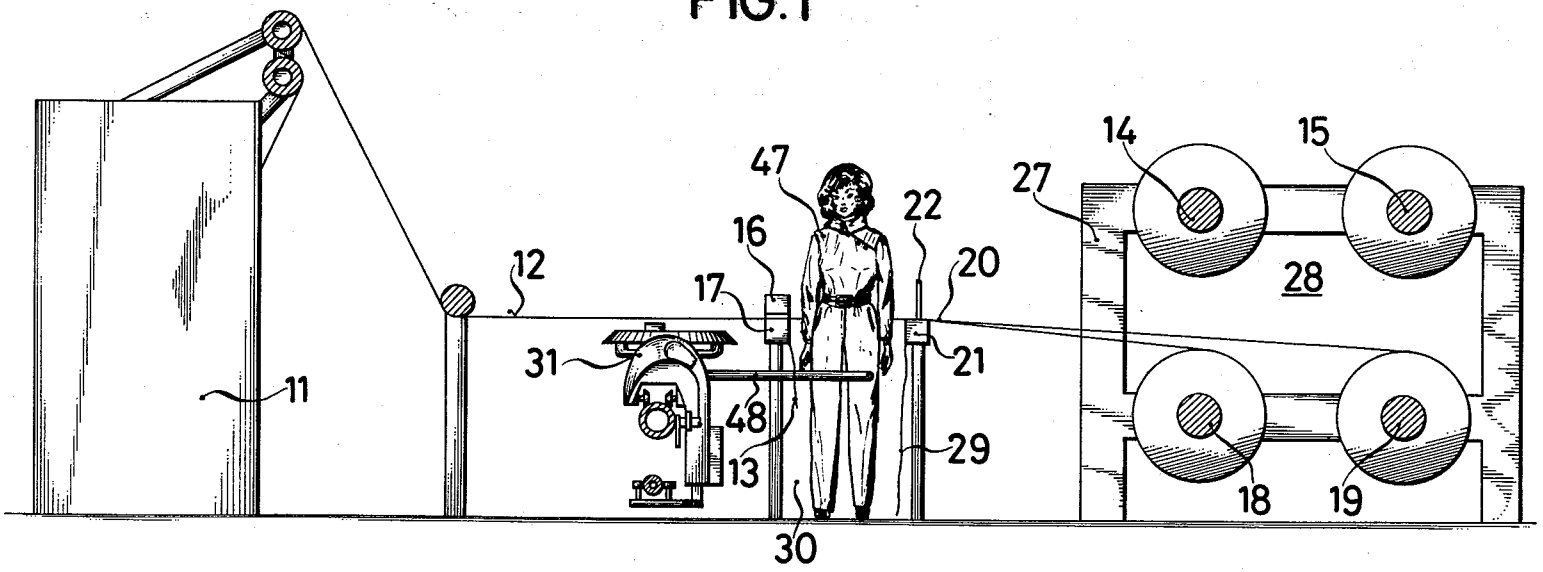
FIG. 1 is a diagrammatic side elevational view of a first embodiment of an apparatus according to the invention.
Figure 2:
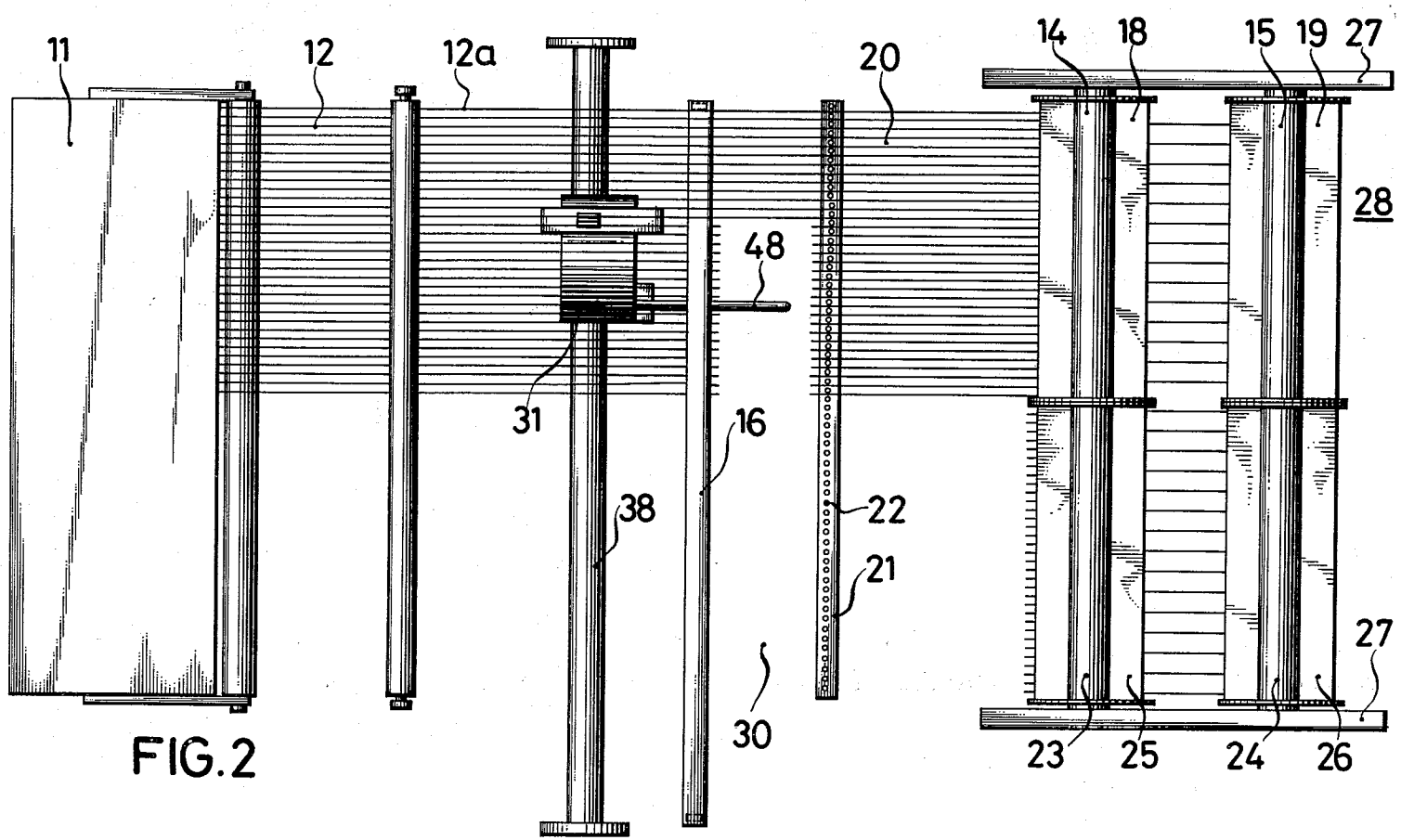
FIG. 2 is a top plan view of FIG. 1.
Figure 3:
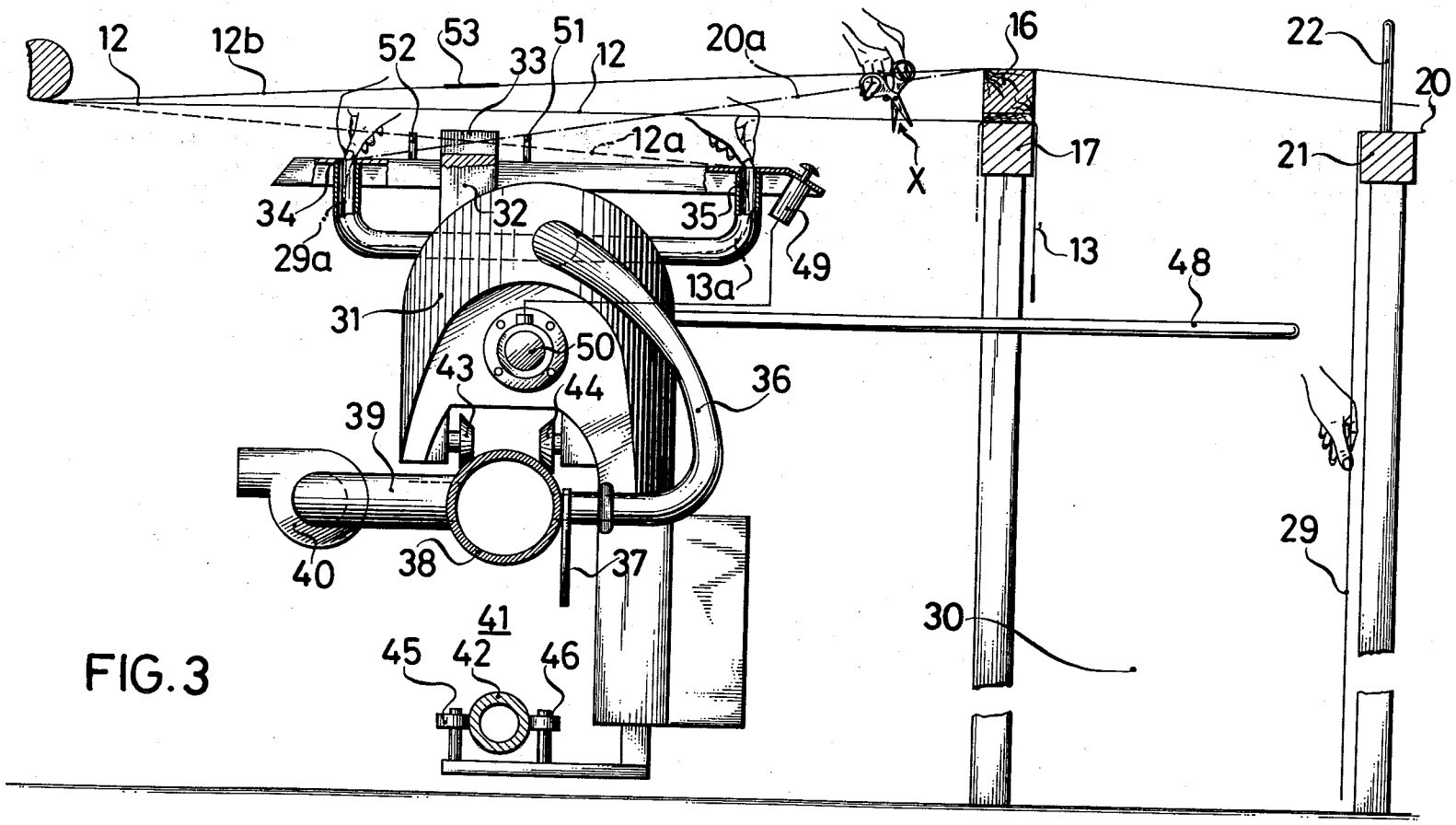
FIG. 3 is an enlarged fragmentary side elevational view of the apparatus of FIGS. 1 and 2.

Referring now to the figures of the drawing and first, particularly, to the first embodiment shown in FIGS. 1 to 3 thereof, there is seen a tufting machine 11 to which a group of threads or a warp is fed. The thread ends 13 of the warp, which is to be extended as the threads run off from the beams 14, 15, are secured by means of a holding device 16. The holding device 16 rests as a clamping beam on a lower beam 17, which is held by supports. The warp 12, with its thread ends 13, is clamped between the two beams 16, 17.

A new warp 20 is pulled off from further beams 18, 19 and is likewise secured with the beginnings of the threads 29 by means of another holding device 21. The holding device 21 has a comb 22. The beams 14, 15, 18, 19, together with further beams 23 to 26, which are supported by a frame 27, jointly form a thread accumulator designated as a whole with reference numeral 28. The beginnings of the threads 29 of the warp 20 hang down from the holding device 21. As long as the warps are not joined together, the two holding devices 16, 21 form the lateral boundaries of an open operating walkway 30.

A pneumatic splicing device 31 is disposed between the tufting machine 11 and the holding device 16. The splicing head 32 i.e. that part of the splicing device 31 which brings about the spliced joints pneumatically, is located horizontally below the horizontal warp 12, with its thread-receiving slot 33 pointing upwards. Alongside the splicing head 32, on one side thereof facing in the direction toward the tufting machine 11, there is disposed a suction nozzle 34 for sucking up the beginning 29*a* of a thread 20*a* of the new warp 20. On the other side thereof, in the direction toward the thread accumulator 28 or in the direction toward the beams 18, 19, there is disposed a further suction nozzle 35 for sucking up the thread end 13*a* of a thread 12*a* of the warp 12 to be extended. Both suction nozzles are connected to a suction line 36 which is, in turn, connected to an underpressure manifold 38 by way of a valve 37. The stationary underpressure manifold 38 is connected to an underpressure source 40 by a line 39.

The pneumatic splicing device 31 is movably disposed on a track arrangement 41 extending transversely to the warp 12. The track arrangement 41 includes the hereinaforementioned underpressure manifold 38 and a support 42. The mobility of the splicing device 31 is ensured by two operating rollers 43, 44 and two support rollers 45, 46. An operator 47 can move the splicing device 31 back and forth on the track arrangement 41 by means of a guide rod 48.

The splicing operation itself is automatic. The control and actuating mechanism required therefor is conventional and therefore not shown specifically. It is, however, fully described in U.S. Pat. Nos. 3,407,583; 3,461,661; and 4,217,749. Only a drive motor 50 which can be switched on and off by a switch 49 connected thereto, is seen. Part of the splicing device includes also two controlled automatic cutting devices 51, 52 for severing the two overhanging thread ends 29*a*, 13*a* of the finished spliced joint 53, indicated in FIG. 3 of the drawing.

FIG. 1 shows the starting condition just prior to the beginning of the extension of the warp 12 by the individual threads of the warp 20. The pneumatic splicing device 31 is brought into position. The thread ends of the warp to be extended and the beginnings of the threads of the new warp are secured in their holding devices. Then, the operator cuts the first thread 12*a* of the warp 12 at the point X shown in FIG. 3 and places its thread end 13*a* in front of the suction nozzle 35. The thread end 13*a* is sucked up and the thread 12*a* is tensioned thereby and placed in the thread receiving slot 33 of the splicing head 32 and in the opened cutting device 51. Then, the operator seizes the beginning 29*a* of the first thread 20*a* of the warp 20, lifts it over the holding device 16 and presents it to the suction nozzle 34 for suctioning. After the thread end 29*a* is sucked in, the thread 20*a* is also taut and is placed in the thread receiving slot 33 and the opened cutting device 52. By pressing the pushbutton of the switch 49, the spliced joint 53 is now automatically made and the excess thread ends are severed by the cutting devices 51 and 52. After the spliced joint is made, the thread 12*a*, which is now already extended, springs up and occupies the taut position 12*b*, shown in FIG. 3.

The splicing now proceeds in the hereinafore described manner, advancing from thread to thread; the operator moves the splicing device 31 a small distance from thread to thread by means of the guide rod 48.

FIG. 2 shows a point in the operation when some threads have already been extended. At the end of the splicing operation, all threads of the warp 12 have been extended by the threads of the warp 20. Subsequently, the holding device 16 is removed and the still clamped, severed thread ends 13 are released thereby. These thread ends are thereupon likewise removed. At the conclusion of this last measure, the tufting machine 11 can be started up again.

It goes without saying that the feed of the pneumatic splicing device and its splicing activity, advancing from thread to thread, can also be performed automatically. In that case, the operator needs to start the device only once at the beginning. Splicing devices suitable for this purpose have likewise been proposed already, for instance, according to German Published, Non-Prosecuted patent application DE-OS No. 28 10 741.

Figure 4:
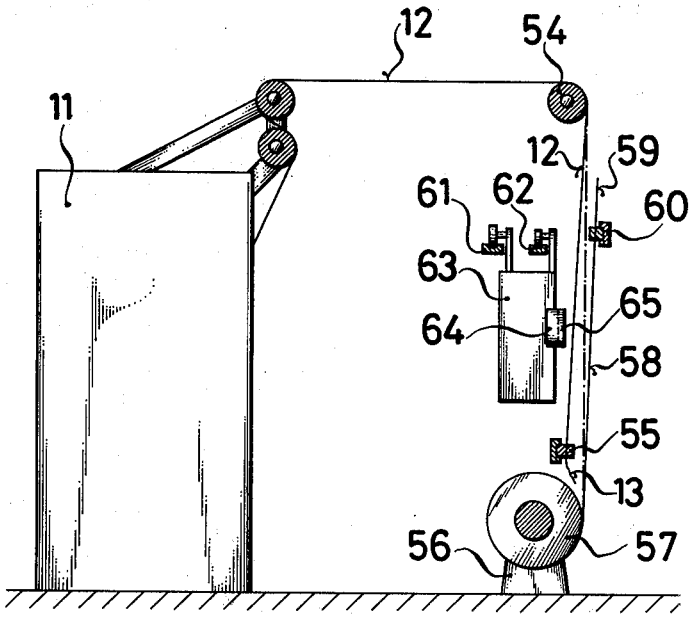
FIG. 4 is a diagrammatic side elevational view of a second embodiment of the apparatus according to the invention.

In the second embodiment example of the invention according to FIG. 4, a somewhat more space-saving construction is shown. Here, the warp 12 of the tufting machine 11 which is to be extended, is brought over a deflection roll 54 and then vertically downward until finally, the thread ends 13 are held in a holding device 55. The thread accumulator 56 in this case, has a beam 57 onto which the new warp 58 is wound. The beginnings 59 of the threads of the warp 58 are secured in a further holding device 60 in such a manner that the warps 12 and 58 run parallel to each other over a certain distance.

The splicing device 63 which can be moved on a track arrangement 61, 62 extending transversely to the warp 12, has a splicing head 64. The thread receiving slot 65 of the splicing head 64 is disposed vertically, pointing toward the vertical warp 12.

The embodiment example according to FIG. 4 is even better suited for automating the splicing operations. The individual threads of the warps are already crossed and need only be fetched into the thread receiving slot 65 by the splicing device 63 to make the spliced joint. In addition, the warp in FIG. 4 can be conveniently divided into several subwarps. The thread accumulators or beams of which can then be staggered one behind the other, with operating walkways in between.

The invention is not limited to the embodiment examples shown and described. Within the scope of the patent claims, other embodiment examples are also possible. The splicing device 31, for instance, can service several tufting machines sequentially. For this purpose, the track arrangements are either extended from one tufting machine to the other, or the splicing device is lifted off and brought to the next tufting machine.

There are claimed:

1. In an apparatus for carrying out a method for extending a warp fed to a tufting machine with a pneumatic splicing device having a slicing head and first and second suction nozzles, the improvement comprising at least one thread accumulator including at least one beam and having at least part of a new warp wound thereon, a first holding device for holding trailing thread ends of the warp to be extended, said first holding device being disposed between the tufting machine and said at least one thread accumulator, and a second holding device for holding leading thread ends of the new warp, the pneumatic splicing device being operable for joining the leading and trailing threads and having the first suction nozzle disposed on a side of the splicing head facing the tufting machine for sucking in the leading thread ends of the new warp, and the second suction nozzle disposed on another side of the splicing head facing said at least one thread accumulator for sucking in the trailing ends of the warp to be extended, the pneumatic splicing device being disposed between the tufting machine and said first holding device.

2. Apparatus according to claim 1, wherein said splicing head is disposed below the warp to be extended and has a thread receiving slot formed therein facing toward the warp to be extended.

3. Apparatus according to claim 1, including an operating walkway having lateral boundaries formed by said first and second holding devices, said operating walkway being open before the warps are joined together.

4. Apparatus according to claim 1, wherein the warp to be extended is at least partially vertically disposed, and said splicing head is disposed alongside the vertical part of the warp to be extended and has a thread receiving slot formed therein facing toward the vertical part of the warp to be extended.

5. Apparatus according to claim 1, including a track disposed transversely to the warp to be extended, said pneumatic splicing device being movably disposed on said track.

6. Apparatus according to claim 1, including means for cutting off the thread ends after joining.

* * * * *